US010143272B2

(12) United States Patent
Fostinis et al.

(10) Patent No.: US 10,143,272 B2
(45) Date of Patent: Dec. 4, 2018

(54) ELECTRONIC STRAP FOR WATCH CASE

(71) Applicant: The Swatch Group Research and Development Ltd, Marin (CH)

(72) Inventors: Dimitri Fostinis, Moutier (CH); Cedric Nicolas, Neuchatel (CH); Pierpasquale Tortora, Neuchatel (CH)

(73) Assignee: The Swatch Group Research and Development ltd, Marin (CH)

( * ) Notice: Subject to any disclaimer, the term of this patent is extended or adjusted under 35 U.S.C. 154(b) by 0 days.

(21) Appl. No.: 15/729,694

(22) Filed: Oct. 11, 2017

(65) Prior Publication Data

US 2018/0103730 A1 Apr. 19, 2018

(30) Foreign Application Priority Data

Oct. 18, 2016 (EP) ..... 16194408

(51) Int. Cl.
*G04G 21/00* (2010.01)
*G04G 17/04* (2006.01)
(Continued)

(52) U.S. Cl.
CPC ..... *A44C 5/14* (2013.01); *A44C 5/0007* (2013.01); *G04B 37/08* (2013.01);
(Continued)

(58) Field of Classification Search
CPC ..... A44C 5/14; A44C 5/0007; G04B 47/063; G04B 37/08; G04B 37/1486; G04B 47/066; G04B 21/02; G04B 17/04; G04G 21/00
See application file for complete search history.

(56) References Cited

U.S. PATENT DOCUMENTS 4,417,819 A 11/1983 Migeon
9,292,008 B1 * 3/2016 Ahamed ..... G06F 1/163
(Continued)

FOREIGN PATENT DOCUMENTS

WO WO 2010/146162 A1 12/2010
WO WO 2015/107523 A1 7/2015

OTHER PUBLICATIONS

European Search Report dated Apr. 25, 2017 in European Application 16194408.7, filed on Oct. 18, 2016 (with English Translation of Categories of cited documents).
David Szondy "Kairos TBand turns almost any watch into a smartwatch", http://www.gizmag.com/kairos-tband/34811/, webpage extracted on Apr. 1, 2016, 3 pages.

*Primary Examiner* — Sean Kayes
(74) *Attorney, Agent, or Firm* — Oblon, McClelland, Maier & Neustadt, L.L.P.

(57) ABSTRACT

The invention relates to an electronic strap for a timepiece, comprising:
- a printed circuit board
- an insert disposed on the printed circuit board, comprising
  - a guide element provided to be placed between and fixed to a pair of horns of a watch case (BM), the guide element comprising a lightwave guide comprising:
  - an input disposed on an interface between the guide element and the printed circuit board
  - a first output disposed so as to be opposite a first zone of the watch case (BM) between the two horns when the guide element is placed between and fixed to the pair of horns
  - a first portion connecting the input to the first output
- a lightwave emitter installed on the printed circuit board, at the level of the input of the wave guide.

12 Claims, 4 Drawing Sheets

(51) Int. Cl.

| | |
|---|---|
| ***A44C 5/14*** | (2006.01) |
| ***G04B 47/06*** | (2006.01) |
| ***G04B 37/08*** | (2006.01) |
| ***G04B 37/14*** | (2006.01) |
| ***A44C 5/00*** | (2006.01) |
| ***G04G 21/02*** | (2010.01) |

(52) U.S. Cl.
CPC ..... *G04B 37/1486* (2013.01); *G04B 47/063* (2013.01); *G04B 47/066* (2013.01); *G04G 17/04* (2013.01); *G04G 21/00* (2013.01); *G04G 21/02* (2013.01)

(56) References Cited

U.S. PATENT DOCUMENTS

| | | | | |
|---|---|---|---|---|
| 9,521,885 | B2 * | 12/2016 | Weber | A44C 5/00 |
| 2008/0004510 | A1 | 1/2008 | Tanzawa et al. | |
| 2012/0082012 | A1 | 4/2012 | Blanckaert et al. | |
| 2015/0124567 | A1 * | 5/2015 | Liao | G04G 17/06 368/10 |
| 2015/0323788 | A1 | 11/2015 | Zou et al. | |
| 2015/0342307 | A1 * | 12/2015 | Weber | A44C 5/00 368/282 |
| 2016/0334759 | A1 * | 11/2016 | Modaragamage | A44C 5/24 |
| 2017/0084133 | A1 * | 3/2017 | Cardinali | G04G 21/00 |
| 2017/0095043 | A1 * | 4/2017 | Weber | A44C 5/00 |
| 2017/0242402 | A1 * | 8/2017 | Francois | G01J 1/50 |

* cited by examiner

ELECTRONIC STRAP FOR WATCH CASE

This application claims priority from European Patent Application No. 16194408.7 filed on Oct. 18, 2016, the entire disclosure of which is hereby incorporated herein by reference.

FIELD OF THE INVENTION

The present invention relates to an electronic strap which is able to be attached to a watch case. There is termed by electronic strap, a strap comprising a moulded flexible printed circuit carrying electronic components which make it possible to accomplish functions, for example to measure the ambient pressure when the strap is worn during a subsea dive. The electronic strap is said to be connected when in addition it is able to communicate with an electronic device, such as a smartphone, for example in order to transmit pressure values to the electronic device.

BACKGROUND OF THE INVENTION

In order to make it possible for mechanical watches to accomplish functions of an electronic watch, even an online watch, whilst avoiding integrating electronic components in the body of the watch cases, electronic straps have been designed which are provided with means for fixing to a mechanical watch case. All the electronic components are integrated in the strap, providing it with numerous functionalities, such as monitoring the physical activity of the wearer of the strap, informing the wearer of a call or message coming in on a smartphone attached to the strap, long-distance controlling of an electronic device, etc.

From this perspective, it is important to be able to notify the wearer of the strap of any sort of event or state relating to the activity of the strap and/or of the electronic device to which the strap is attached. An event or a state relating to the activity of the strap and/or of the electronic device to which the strap is attached is by way of example but non-limiting: activation or deactivation of a function of the strap, the progress of a function by the strap (for example measurements recorded by the sensors of the strap), establishment or completion of a data transfer between the strap and the electronic device, the progress of a data transfer between the strap and the electronic device, receipt of a call or of a message by the electronic device, etc.

SUMMARY OF THE INVENTION

The aim of the present invention is to meet the requirement cited previously.

To this end, the invention relates to an electronic strap for a timepiece, comprising:

- a printed circuit board
- an insert disposed on the printed circuit board, comprising
  - a guide element provided to be placed between and fixed to a pair of horns of a watch case, the guide element comprising a lightwave guide comprising:
    - an input disposed on an interface between the guide element and the printed circuit board
    - a first output disposed so as to be opposite a first zone of the watch case between the two horns when the guide element is placed between and fixed to the pair of horns
  - a first portion connecting the input to the first output
- a lightwave emitter installed on the printed circuit board, at the level of the input of the waveguide.

Hence, when the lightwave emitter emits a lightwave, the lightwave penetrates into the lightwave guide via the input disposed on the interface between the guide element and the central part, is propagated as far as the first output via the first portion, and is finally directed to the level of the first zone, where it is reflected and consequently is visible to the wearer of the strap.

Other advantageous features of the electronic strap according to the invention, being able to be taken in isolation or in combination, are defined in claims 2 to 8.

The invention relates likewise to a timepiece comprising a strap according to the invention, the guide element being placed between and fixed to a pair of horns of the watch case.

Other advantageous features of the timepiece according to the invention, being able to be taken in isolation or in combination, are defined in claims 10 to 12.

BRIEF DESCRIPTION OF THE FIGURES

Other features and advantages will emerge clearly from the description which is given hereafter, by way of indication and in no way limiting, with reference to the annexed Figures which show.

DETAILED DESCRIPTION OF PREFERRED EMBODIMENTS

The invention relates to a timepiece comprising an electronic strap fixed to a watch case via for example two bars.

Figure 1:
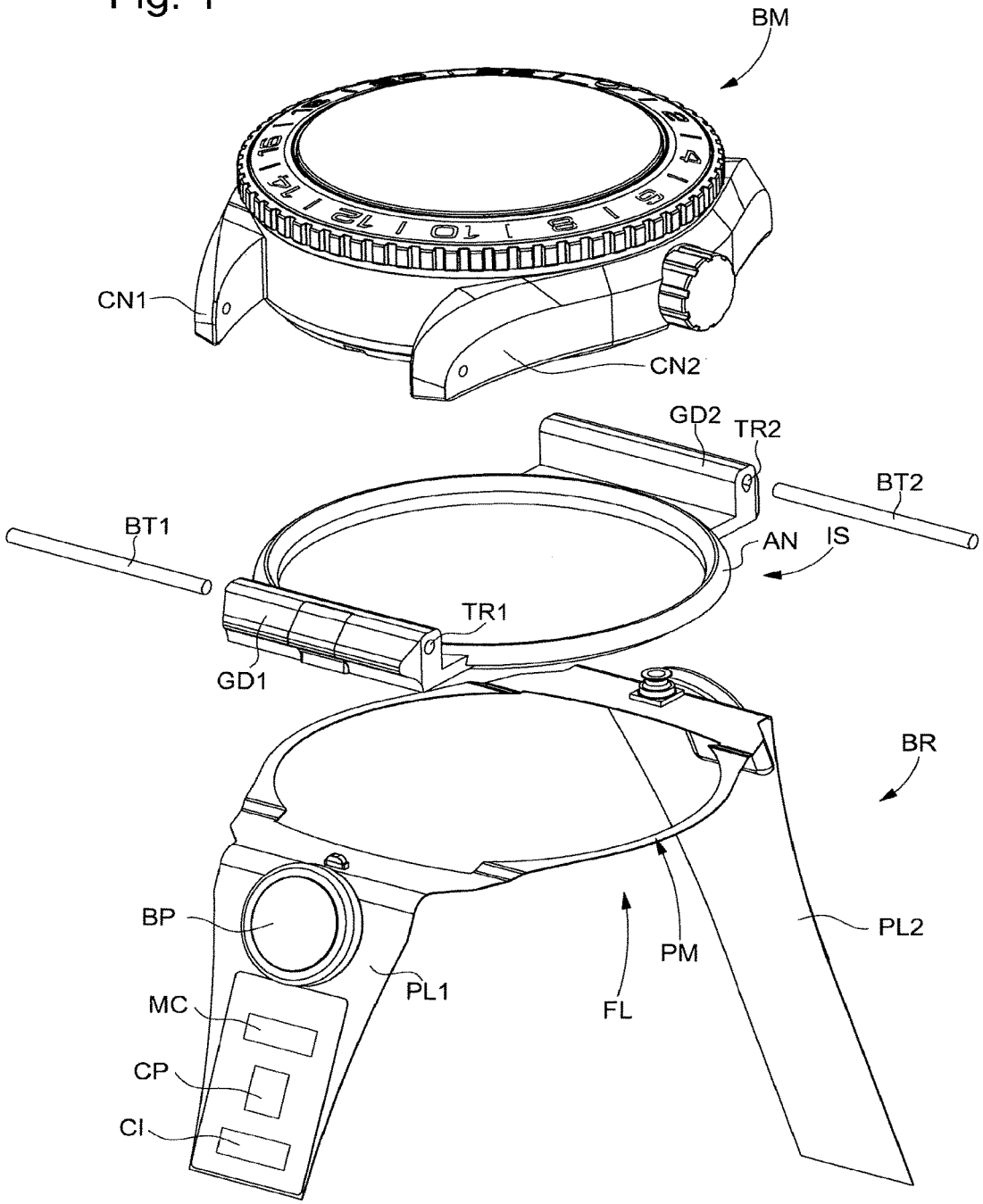
In FIG. 1, a perspective view of the disconnected state of some elements of a timepiece according to the invention, including a printed circuit board, an insert, a watch case and two bars.

In FIG. 1, there is represented an embodiment which is preferred but non-limiting of elements of an electronic strap BR according to the invention. According to this preferred embodiment, the electronic strap BR is of the cuff type; the strap BR comprises a printed circuit board FL formed in one piece from a first lateral portion PL1, from a central part PM which is globally annular and extends the first lateral portion PL1, and from a second lateral portion PL2 which extends the central part PM. Each of these lateral portions PL1, PL2 is one element of one of the two arms of the strap: each arm of the strap comprises therefore a portion of the printed circuit.

In non-represented alternative embodiments, the strap is not of the cuff type but on the contrary is formed from two separate parts. In a first of these alternative embodiments, the printed circuit board is formed from two separate portions. The board in fact does not comprise a central part and is formed by only two lateral portions PL1, PL2, which are disconnected electrically and mechanically. Each of these lateral portions PL1, PL2 is an element of one of the two arms of the strap: each arm of the strap comprises therefore a portion of printed circuit. In a second of these alternative embodiments, the printed circuit board comprises only the first lateral portion PL1. The first lateral portion PL1 is an element of one of the two arms of the strap; the second arm of the strap does not comprise a printed circuit.

The strap BR likewise comprises an assembly of electrical and/or electronic components which are mounted on the first lateral portion PL1 and possibly on the second lateral portion PL2 when the latter is present. The components comprise for example a microcontroller MC, an electrical energy source SE (visible in FIG. 3 only), and communication means CI with an electronic device for example via a wireless interface of the Bluetooth, WiFi or NFC type, etc. The components can also comprise one or more sensors CP and/or one or more push buttons BP.

In the embodiment which is preferred and represented in FIG. 1, i.e. in the case of the cuff strap, the strap BR comprises, furthermore, an insert IS which is intended to be disposed on the central part PM of the printed circuit board FL. The insert IS comprises a rigid ring AN and two guide elements GD1, GD2 which are diametrically opposite. The guide elements GD1, GD2 are intended to be disposed on the central part PM of the printed circuit board, at the interface with the lateral portions PL1, PL2, The watch case BM is intended to be disposed above said insert IS, each guide element GD1, GD2 being provided to be placed between a pair of horns CN1, CN2 of the watch case BM. The guide elements GD1, GD2 are each pierced by a hole TR1, TR2 for passage of the bars BT1, BT2, said bars BT1, BT2 making it possible to fix the pairs of horns of the watch case on the insert IS.

Figure 2:
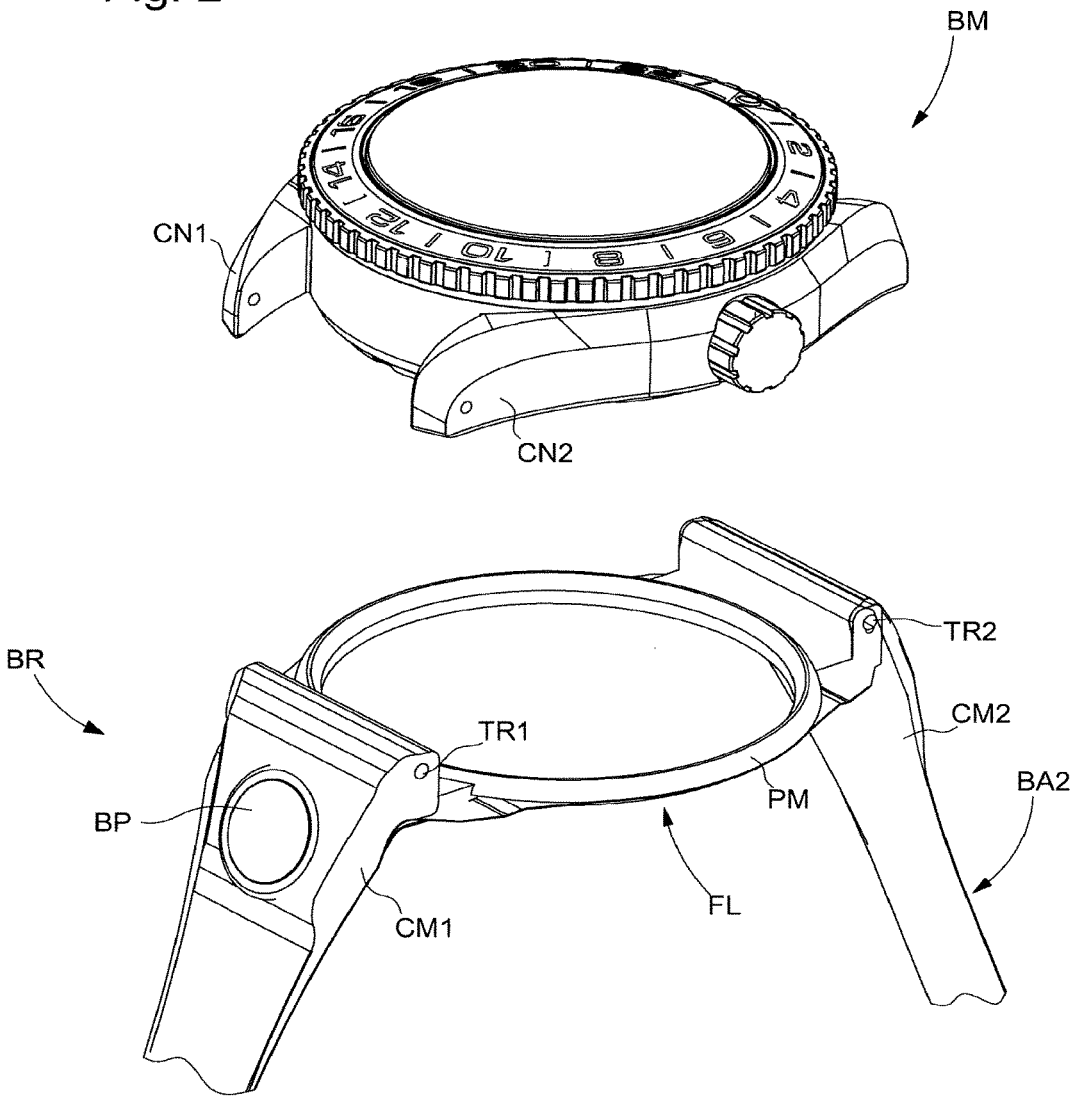
In FIG. 2, a perspective view of the disconnected state of elements of FIG. 1, including the printed circuit board, the insert and the watch case, a moulded layer having been added to the printed circuit board.

As is visible in FIG. 2, the strap BR likewise comprises a moulded layer CM1, CM2, for example made of a plastic or elastomeric material, added when the assembly of components was mounted on the lateral portions PL1, PL2 of the printed circuit board FL and when the insert IS was suitably disposed on the central part PM of the printed circuit board FL. The moulded layer makes it possible to protect the components carried by the lateral portions PL1, PL2 of the printed circuit board FL and to integrate the insert IS and the printed circuit board FL. For this purpose, the moulded layer comprises two portions CM1, CM2. A first moulded portion CM1 covers the first lateral portion PL1 of the printed circuit board FL and one of the guide elements GD1 of the insert IS so as to create a first arm BA1 of the strap. A second moulded portion CM2 covers the second lateral portion PL2 of the printed circuit board FL and the other of the guide elements GD2 of the insert IS so as to create a second arm of the strap BA2. In the first and second alternative embodiments, the strap does not comprise the entirety of the insert, but only the guide elements GD1, GD2, each being part of one of the arms of the strap. In the first alternative embodiment, each guide element GD1, GD2 is intended to be disposed on an external part of the lateral portions PL1, PL2, then to be placed between a pair of horns CN1, CN2 of the watch case BM. The moulded portions CM1, CM2 allow, inter alia, integration of the lateral portions PL1, PL2 with the guide elements GD1, GD2. In the second alternative embodiment, the first guide element GD1 is intended to be disposed on an end part of the first lateral portion PL1, then to be placed between a pair of horns CN1, CN2 of the watch case BM; the second guide element GD2 is an element of the second arm of the strap which allows integration thereof with the other pair of horns of the watch case BM. The first moulded portion CM1 allows, inter alia, integration of the first lateral portion PL1 with the first guide element GD1.

Figure 3:
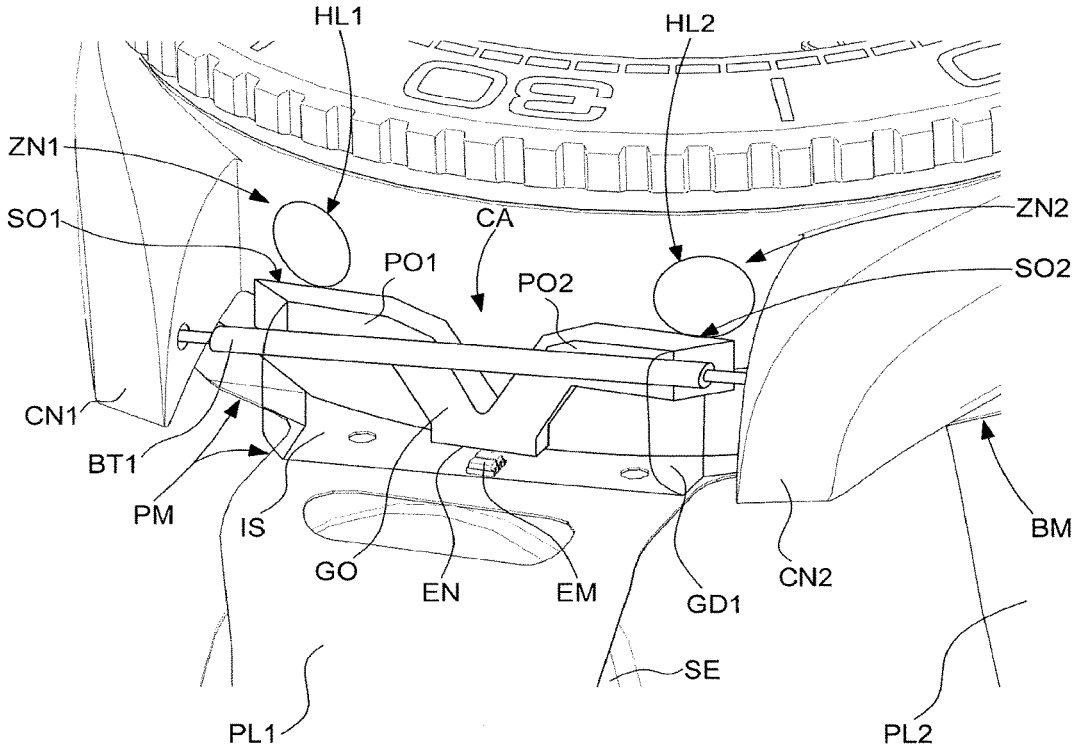
In FIG. 3, a perspective view of elements of FIG. 1, including the printed circuit board, a guide element of the insert, the watch case and a bar.
Figure 4:
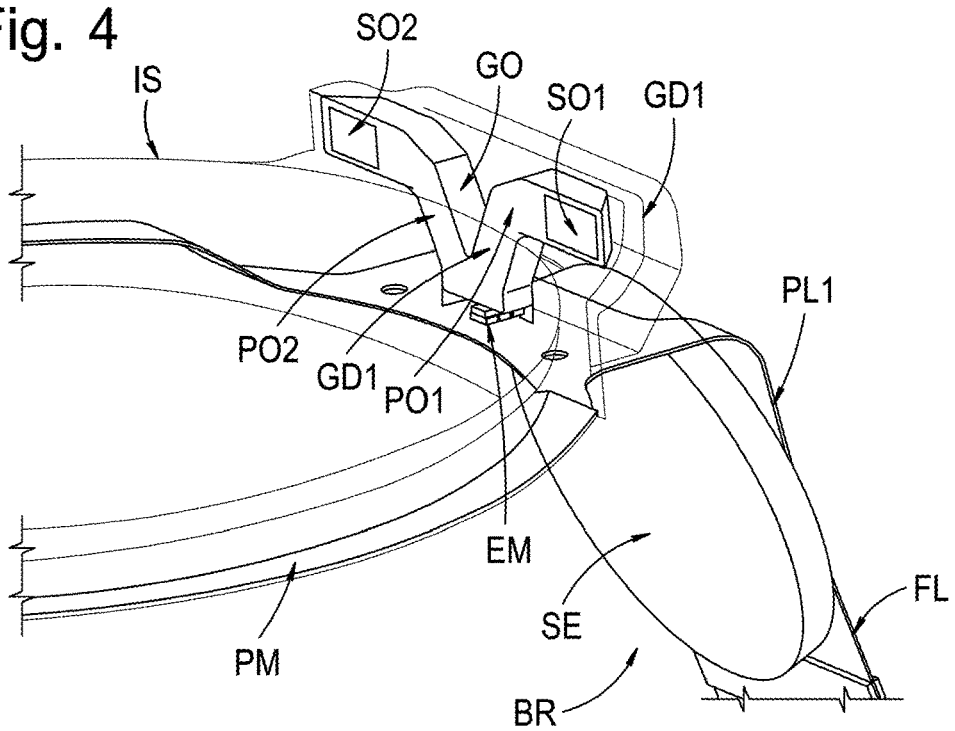
In FIG. 4, a perspective view of elements of FIG. 3, including a lightwave guide of the guide element and the printed circuit board.

As visible in FIGS. 3 and 4, the strap BR according to the invention is wherein the first guide element GD1 which is fixed or intended to be fixed to one of the pairs of horns CN1, CN2 comprises a lightwave guide GO, and wherein the printed circuit board FL carries a lightwave emitter EM which is connected electrically to the assembly of components and disposed opposite an input EN of the lightwave guide GO. In a preferred embodiment, the wave guide GO is formed from plastic, or any other transparent material. It can be seen that the location of the wave guide GO in the first guide element GD1 makes it possible to make it unobtrusive in order not to affect the aesthetics of the timepiece.

In the non-limiting embodiment of FIG. 3, the lightwave guide GO comprises two outputs SO1, SO2 and two portions PO1, PO2 in order to connect the input EN to each of the outputs SO1, SO2. However, the wave guide GO could comprise only one output and only one portion for connecting the input to said output, or more than two outputs and as many portions as outputs. The wave guide GO could likewise comprise more than one input: the guide would then comprise as many portions as necessary to connect each input to each output. In this case, the central part PM would carry as many emitters of lightwaves as inputs, each emitter being intended to be disposed opposite an input of the lightwave guide GO.

The first output SO1 and the second output SO2 are disposed so as to be opposite a portion of the case middle CA of the watch case BA between the two horns CN1, CN2. Hence, a lightwave emitted by the lightwave emitter EM is guided and directed towards the portion of the case middle CA, where it is visible to the wearer of the timepiece. The lightwave forms two light halos HL1, HL2, on the portion of the case middle CA, represented in FIG. 3. The first light halo HL1 is visible at the level of a first zone ZN1 of the portion of the case middle CA, the first zone ZN1 being opposite the first output SO1 of the lightwave guide GO. The second light halo HL2 is visible at the level of a second zone ZN2 of the portion of the case middle CA, the second zone ZN2 being opposite the second output SO2 of the lightwave guide GO.

Of course, in the case where the wave guide GO would comprise only one output, only one light halo would be visible. A long light halo extending from one horn to the other would be conceivable, just as a halo situated at the side of one horn or a halo situated substantially at an equal distance from the two horns. In the case where the waveguide would comprise more than two outputs, as many light halos as outputs would be visible. It can be seen likewise that the shape of the halo(s) depends upon the shape of the output(s).

It can be seen that, in the represented example, the first output SO1 is disposed at the side of the first horn CN1, whilst the second output SO2 is disposed at the side of the second horn CN2. Although this is not essential, it is advantageous to place the outputs SO1, SO2 of the lightwave guide GO near the horns CN1 for watch cases, the portion of the case middle CA of which is curved. In fact, in this case, the space between the portion of the case middle CA is minimal at an equal distance between the horns CN1, CN2 and maximal near the horns CN1, CN2. Now, placing an output of the lightwave guide GO too near the portion of the case middle CA could impair visibility of a lightwave guided by the lightwave guide, since the light halo on the portion of the case middle CA could be obscured by the guide element EG1. Of course, these considerations are not applicable for watch cases which are square or rectangular since the strap would be equidistant from the portion of the case middle over the entire width thereof.

Furthermore, in order to obtain light halos HL1, HL2 of similar intensity, it is advantageous to place the input EN of the light guide GO at a substantially equal distance from the first output SO1 and from the second output SO2. The light guide GO is then globally in the form of a V. However, various different configurations of the light guide GO are conceivable as the space of the light guide GO remains limited.

Furthermore, the lightwave emitter EM comprises at least one punctiform source of lightwaves, for example an electroluminescent diode. Advantageously, the lightwave emitter EM comprises several punctiform sources close to each other, the sources being able to emit light waves at different frequencies, i.e. with different colours. Hence, the punctiform sources can be either extinguished or illuminated in order to create light halos of a particular colour as a function of the information to be provided to the wearer of the timepiece. Of course the at least one punctiform source can likewise be illuminated according to a temporal sequence corresponding to information to be provided to the wearer of the timepiece.

Since the lightwave emitter EM is connected electrically to the assembly of electrical and/or electronic components, the at least one punctiform source of the lightwave emitter EM can be activated as a function of an event or a state relating to the activity of the strap or of an electronic device to which the strap is attached. For example, the punctiform source can be activated when the push button BP is pressed, when a message is received by the electronic device, or even when data are transferred between the strap BR and the electronic device.

Figure 5:
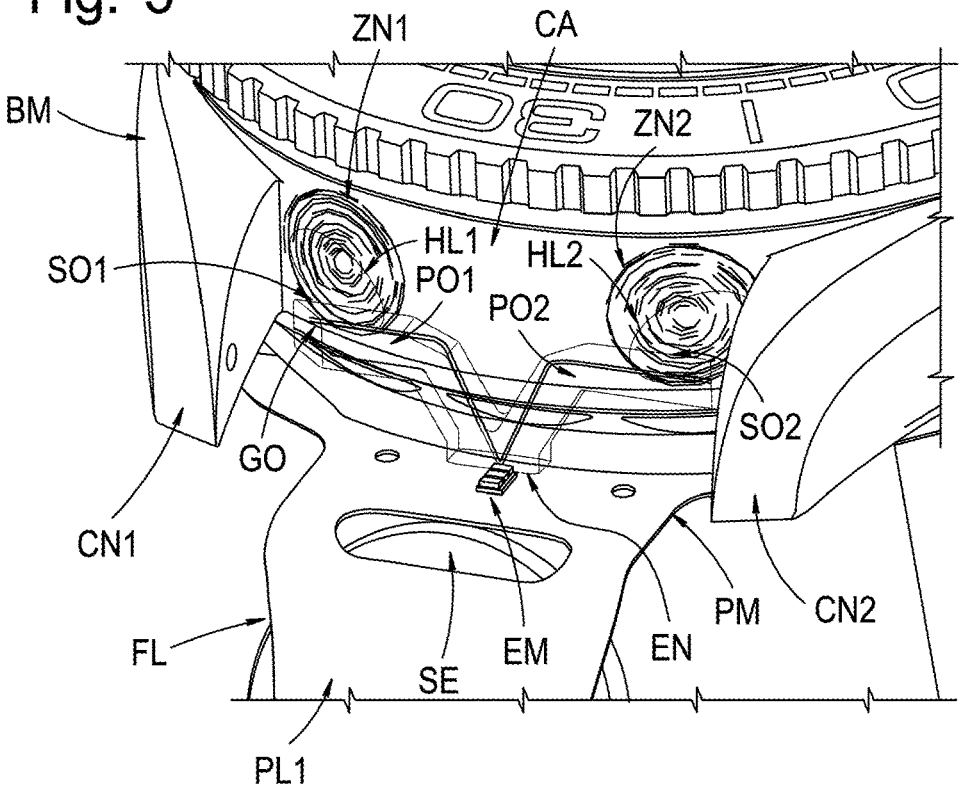
In FIG. 5, a perspective view of a watch case, the case middle of which has undergone a surface treatment, and the lightwave guide and the printed circuit board of FIG. 4.

It can be seen that, in order to modify the reflection of the light on the portion of the case middle CA and thus to modify the light shapes and/or intensities of the halos HL1, HL2 which are seen by the wearer of the timepiece, it would be possible to produce surface treatments of the zones ZN1, ZN2. An example of a surface treatment is shown in FIG. 5. In this example, concentric rings have been produced by cavities at the level of the zones ZN1, ZN2 so as to produce a Fresnel lens effect. Microstructurings by laser or other means would likewise be conceivable in order to create different effects, such as better diffusion of the light, or to highlight a motif, for example a logo. Sandblasting (i.e. a projection of sand under pressure) of zones ZN1, ZN2 could likewise be produced in order to make the zones ZN1, ZN2 irregular: the halos HL1, HL2 would be less bright but more extensive and therefore more aesthetic.

Of course, the present invention is not limited to the illustrated example but is able to have different variants and modifications which will be apparent to the person skilled in the art.

What is claimed is:

1. An electronic strap for a timepiece, comprising:
- a printed circuit board
- an insert disposed on the printed circuit board, comprising
  - a guide element provided to be placed between and fixed to a pair of horns of a watch case, the guide element comprising a lightwave guide comprising:
    - an input disposed on an interface between the guide element and the printed circuit board
    - a first output disposed so as to be opposite a first zone of the watch case between the two horns when the guide element is placed between and fixed to the pair of horns
    - a first portion connecting the input to the first output
- a lightwave emitter installed on the printed circuit board, at the level of the input of the wave guide.

2. The strap according to claim 1, the waveguide comprising a second output disposed so as to be opposite a second zone of the watch case between the two horns when the guide element is placed between and fixed to the pair of horns and comprising a second portion connecting the input to the second output.

3. The strap according to claim 2, the first output and the second output being disposed so that the first zone is situated on the side of one of the horns, and so that the second zone is situated on the side of the other of the horns.

4. The strap according to claim 1, the lightwave emitter comprising at least two wave sources of different frequencies.

5. The strap according to claim 1, the lightwave guide being transparent.

6. The strap according to claim 1, the printed circuit board comprising a first lateral portion and an assembly of components, including an energy source and a microcontroller, the assembly of components being mounted on the first lateral portion, the lightwave emitter being connected electrically to the assembly of components.

7. The strap according to claim 6, the assembly of components comprising at least one push button.

8. The strap according to claim 1, the assembly of components comprising means of communication with another electronic object via a wireless communication system of the Bluetooth, WiFi or NFC type.

9. A timepiece comprising a strap according to claim 1 and a watch case, the guide element being placed between and fixed to a pair of horns of the watch case.

10. The timepiece according to claim 9, the first zone having a Fresnel lens appearance.

11. The timepiece according to claim 9, the first zone having an irregular surface.

12. The timepiece according to claim 11, the first zone being sandblasted or structured.

* * * * *